US005107857A

United States Patent [19]

Linnemann et al.

[11] Patent Number: 5,107,857

[45] Date of Patent: * Apr. 28, 1992

[54] DISPOSABLE DECONTAMINATION UNIT

[75] Inventors: Thomas Linnemann, Holland; Kurt Linnemann, Hatboro, both of Pa.

[73] Assignee: Radiation Management Consultants, Inc., Philadelphia, Pa.

[ * ] Notice: The portion of the term of this patent subsequent to Oct. 2, 2007 has been disclaimed.

[21] Appl. No.: 515,214

[22] Filed: Apr. 27, 1990

Related U.S. Application Data

[63] Continuation of Ser. No. 335,825, Apr. 10, 1989, Pat. No. 4,960,136.

[51] Int. Cl.[5] ..... A61G 7/00

[52] U.S. Cl. ..... 128/845; 604/356; 4/587

[58] Field of Search ..... 128/845, 846, 847, 586, 128/585, 587, 575

[56] References Cited

U.S. PATENT DOCUMENTS

| | | | |
|---|---|---|---|
| 482,368 | 9/1992 | Kimber | 4/587 |
| 3,246,346 | 4/1966 | Schmidt | 4/585 |
| 3,537,116 | 9/1968 | Kain | 4/586 |
| 4,393,531 | 7/1983 | Hodel | 4/585 |
| 4,960,136 | 10/1990 | Linnemann | 4/587 |

FOREIGN PATENT DOCUMENTS

| | | | |
|---|---|---|---|
| 65878 | 10/1926 | Sweden | 4/585 |

*Primary Examiner*—Robert A. Hafer
*Assistant Examiner*—David J. Kenealy
*Attorney, Agent, or Firm*—Eugene E. Renz, Jr.

[57] ABSTRACT

A disposable decontamination device, comprising a fordable frame expandable to define a rectangular shape sized to accommodate a patient, a fluid resistant fabric formed into a basin sized to enclose said frame when positioned a patient on a backboard in on said basin and a collection vessel and drain means for transferring fliud from said basin to said vessel.

6 Claims, 5 Drawing Sheets

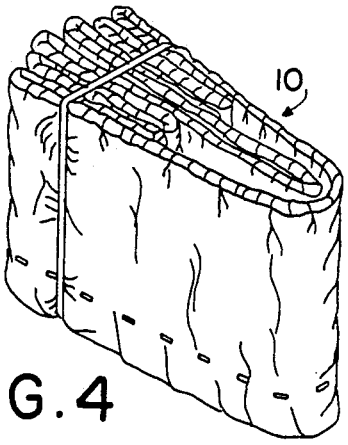
FIG. 4
FIG. 5
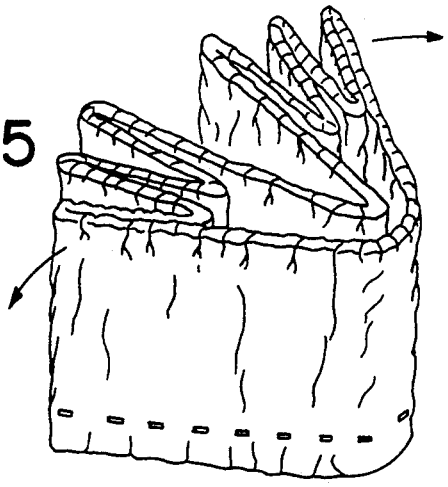
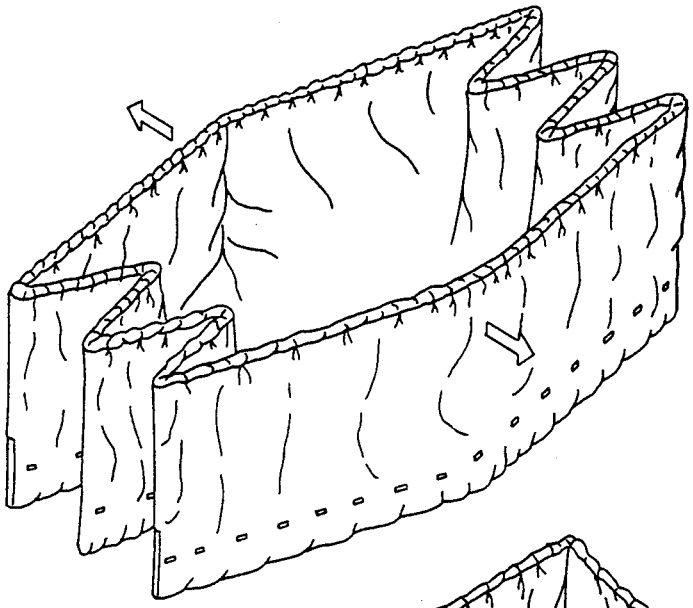
FIG. 6
FIG. 7
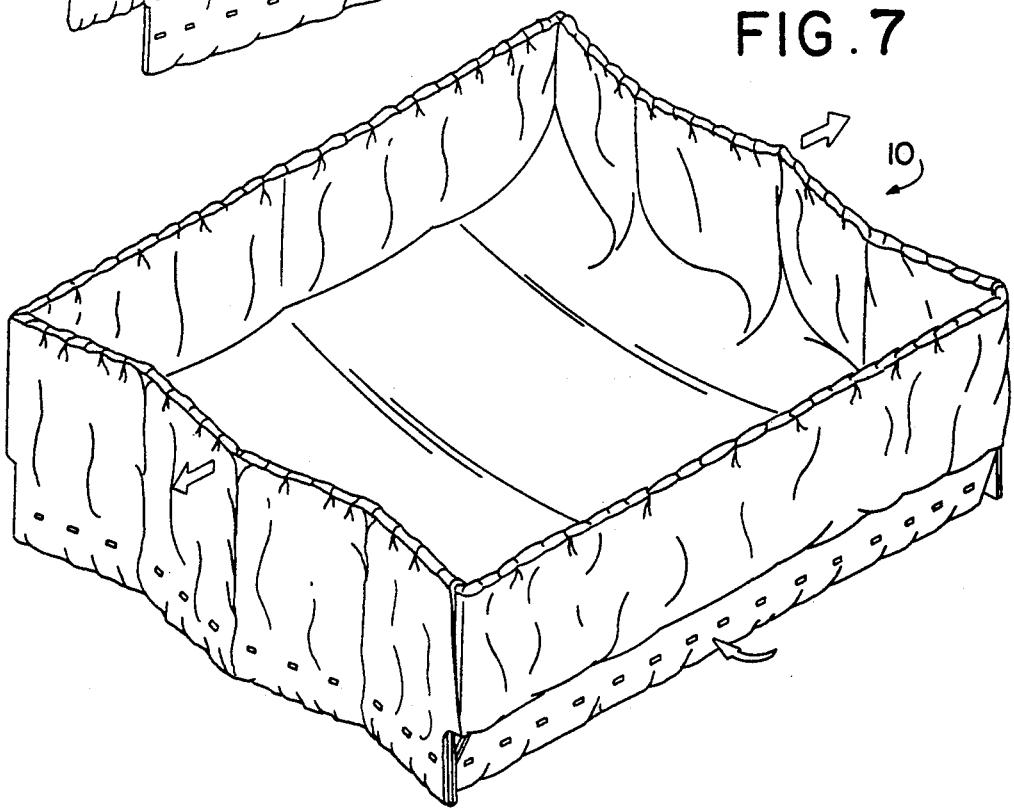

DISPOSABLE DECONTAMINATION UNIT

This is a Continuation of Co-Pending Patent Application, Ser. No. 07/335,825; filed Apr. 10, 1989, now U.S. Pat. No. 4,960,136.

FIELD OF THE INVENTION

This invention relates to a disposable decontamination device which facilitates the delivery of emergency medical treatment to a contaminated patient while providing for the removal and collection of the contaminants.

BACKGROUND OF THE INVENTION

Injuries or illnesses complicated by the presence of radiological, chemical, biological and other hazardous contaminants present a unique problem to the medical community. Immediate medical care must be delivered to a contaminated accident victim. It is also imperative that these contaminants be contained and disposed of properly in order to minimize potential hazards to victims, attendants, equipment, emergency response vehicles and to the medical care facility. It is necessary to deliver emergency medical treatment while providing a method for removing and collecting the contaminants. In addition, disposal of body fluids from a patient, where there is a possibility that the patient carries any infectious disease, is a particular concern of everyone at risk to contact with the fluids.

Prior art method for facilitating medical treatments, decontamination and containment of the contaminants from an injured contaminated victim have not been effective. Particularly when the victim is not ambulatory and has extensive contamination, there has not yet been an effective procedure developed to rapidly treat and decontaminate the victim without excess movement of the victim and/or spreading the contaminants.

Prior methods for decontaminating contaminated patients requires that the patient be placed in a decontamination unit with concave supports and the like. The decontamination units have been ineffective initially removing all contamination from the patient, and were unable to provide an enlarged patient support area for use during medical treatment. No device has yet been made available which can be used in combination with standard and readily available ambulance and hospital gurney and stretchers.

It is a particular concern in the medical emergency treatment field to provide some way to protect the rescue personnel and, if possible the vehicle or treatment location, such as an ambulance, first aid station or a hospital. When an emergency response is needed, every effort is made to help the patient in need, sometimes at unreasonable risk to the ambulance attendant or hospital staff. Accordingly, a self contained unit which would safely decontaminate a patient and protect those coming to his or her assistance would be of great value.

It would be of great advantage to the medical community if a decontamination table could be provided which would facilitate rapid emergency medical care and would permit the removal of toxic chemical, radioactive materials or biological agents, organism and other hazardous contaminants from non-ambulatory patients. In addition, such a table would be extremely useful in treating burn injuries and in cooling victims of hypothermia. Such a decontamination table wold also be very suitable for use by morticians and medical personnel performing autopsies.

U.S. Pat. No. 2,569,561 discloses a film holder and drain pan, but it cannot easily be adapted for field use, is not disposable and does not cover the entire patient. U.S. Pat. No. 4,650,171 discloses an autopsy table which is also not disposable and which does not prevent loss of fluids to the environment.

SUMMARY OF THE INVENTION

It has now been discovered that the objects of the present invention can be accomplished in the following manner. Specifically, a highly effective self-contained and comprehensive disposable decontamination unit is now available for use to treat patients in the field where those patients have been contaminated by radiological, chemical, biological and other hazardous contaminants. Immediate care is available. Both the contaminants and the unit itself may be disposed of to minimize or eliminate potential hazard to the victim, attendants equipment, vehicles and to the facility itself.

Specifically, the invention comprises a disposable decontamination device including a foldable frame which is expandable to define a rectangular shape sized to accommodate a patient. Also included is a contaminated fluid resistant fabric which is formed into a basin of a size to enclose the frame when positioning a patient in the basin. Finally, a collection vessel and drain means are provided for transferring fluid from the basin to the vessel.

In a preferred embodiment, the disposable decontamination device may most effectively be used with a gurney or stretcher and a backboard. The device includes an expandable, folded frame having sides and ends which extend vertically to form an expanded rectangle. The rectangle is large enough to accommodate the backboard. The device includes an expandable, folded frame having sides and ends which extend vertically to form an expanded rectangle. The rectangle is large enough to accommodate the backboard and small enough to fit on the gurney to enclose a portion of the pad or top of the gurney. The frame also include means for stabilizing the frame in its rectangular position. The contaminating fluid resistant fabric is formed into a basis which is sized to include the frame to receive a patient on the backboard. The basin is attached to the frame and covers at least the inside of the frame and the portion of the gurney enclosed by the frame. The patient actually rests on the fabric which is supported by the pad of the gurney. A collection vessel is positioned below the basin and includes a drain means attached tot he basin and vessel for transferring fluid from the basin to the vessel. In a preferred embodiment, the drain means includes a valve so that fluid does not escape from the vessel until it is properly disposed.

BRIEF DESCRIPTION OF THE DRAWINGS

These and other objects of the present invention and the various features and details of the operation and construction thereof are hereinafter more fully set forth with reference to the accompanying drawings, where:

FIG. 4 is a perspective view illustrating the disposable decontamination device of this invention, shown in a folded condition.

FIG. 5-7 inclusive, are perspective views illustrating the sequential unfolding of the disposable decontamination device of this invention as shown in FIG. 1.

DETAILED DESCRIPTION OF THE PREFERRED EMBODIMENT

The present invention has been designed to allow medical treatment and patient decontamination from chemical, biological, radiological and other hazardous materials. The system is also useful in treating heat-relating injuries such as burns and heatstroke. The system has been specially designed as a space saving and economical way to treat trauma and/or contaminated patients. A vinyl coated nylon is used as a basin. This nylon is one of the most durable and chemical resistant material presently available. The collapsible collection vessel and drain means along with the collapsible frame folds into a 24 inch by 15 inch by 4 inch package which can easily be stored in any emergency vehicle or in various places at hazardous facilities.

The device as contemplated is preassembled and disposable. It is rapidly put into use and can be set up in less than one minute. The compact design when folded is easily stored and yet it is compatible with standard backboards and hospital or ambulance stretchers or gurneys. it is light in weight, being manufactured from inexpensive and lightweight materials. The frame itself can be manufactured from cardboard or boxboard and does not require additional reinforcement. In its expanded size, the frame is typically about 84 inches long and 24 inches wide and 8 inches high.

Provided with the system is a collection vessel, which is typically about five gallons in size, and which is connected to the basin by polyvinylchloride tubing. The tubing connects the basin and the collection vessel. In a preferred embodiment, the tubing includes a drain which has a valve, so that fluids don't recontaminate the patient or anyone else once the fluids have been transferred to the collection vessel.

Figure 1:
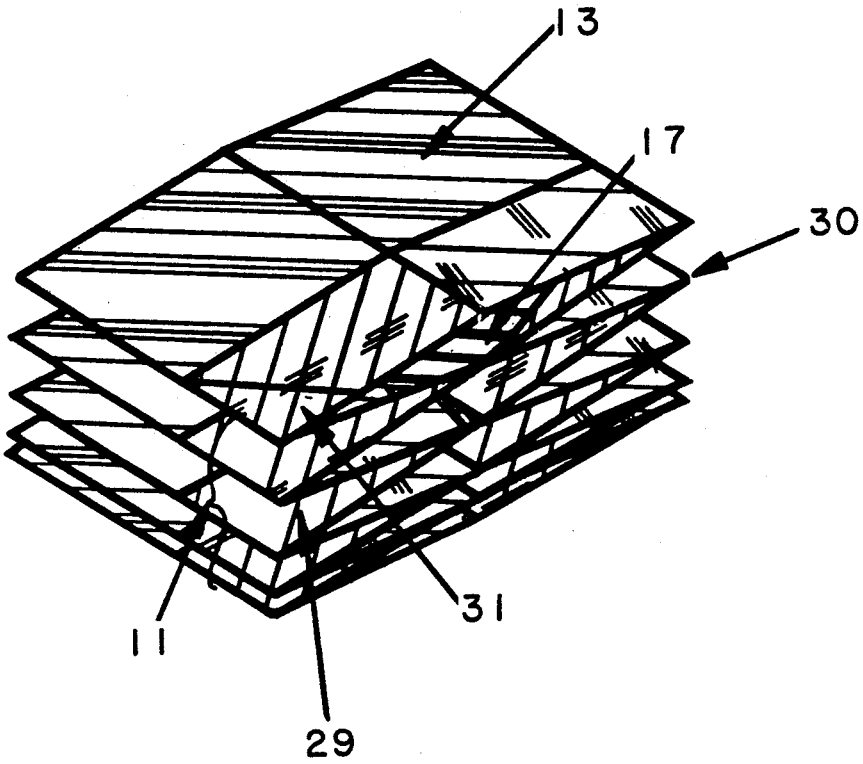
FIG. 1 is a perspective view illustrating the disposable decontamination device of this invention, shown in a folded condition and containing a collapsed transfer vessel.
Figure 2:
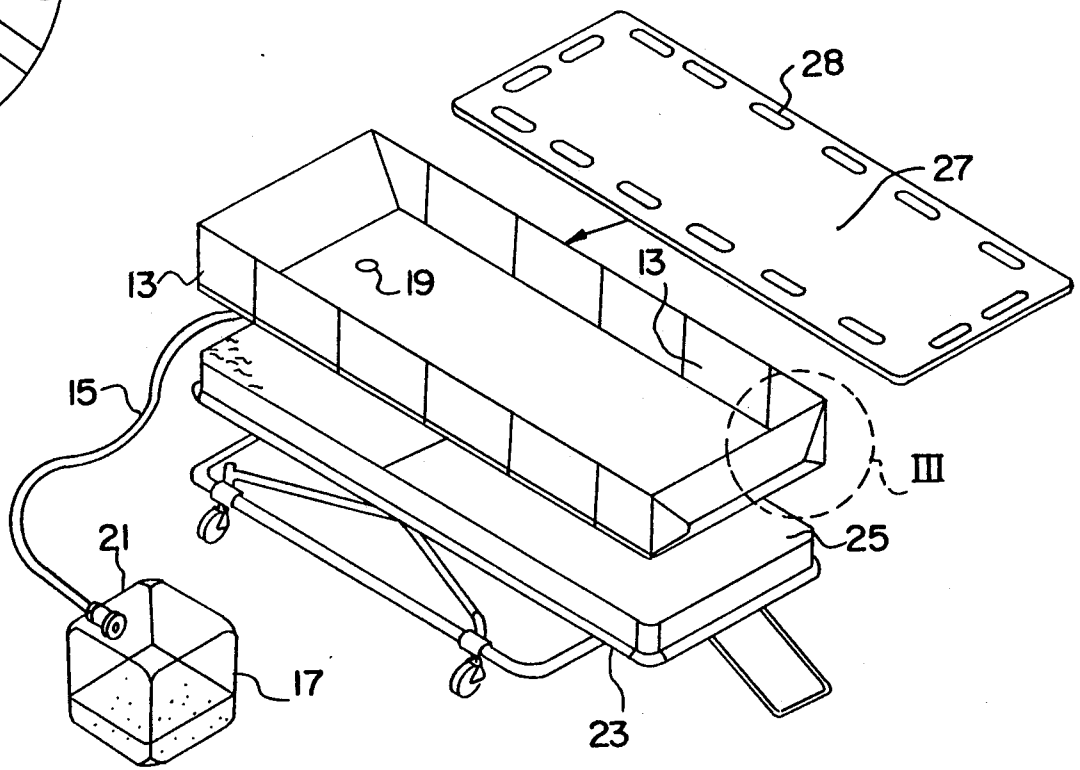
FIG. 2 is an exploded perspective view of the decontamination device of the present invention shown in an expanded rectangular shape, in combination with an ambulance gurney and a backboard for transporting patients.
Figure 3:
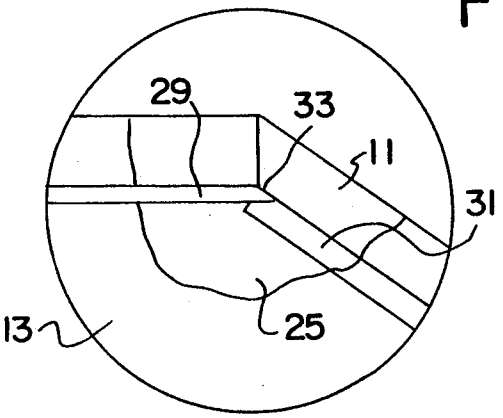
FIG. 3 is a cutaway of the dotted portion III of FIG. 2, with the basin fabric removed showing an embodiment for maintaining the shape of the rectangular frame.
Figure 8:
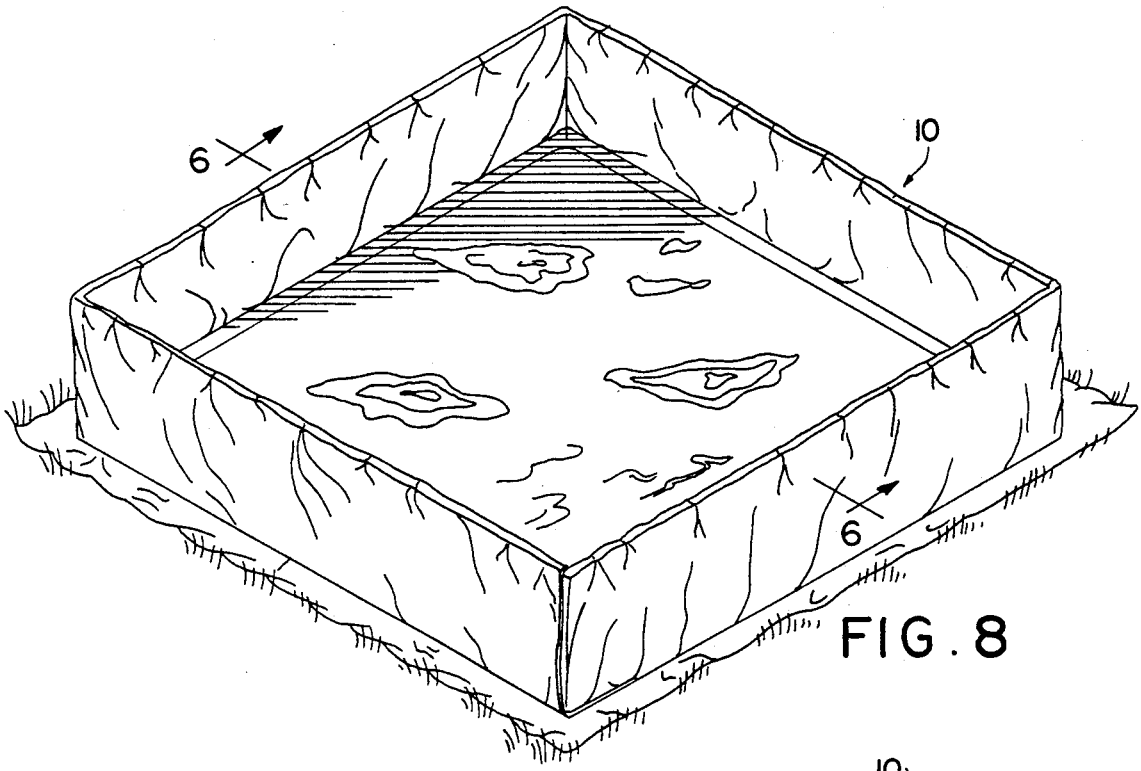
FIGS. 8 is a perspective view illustrating the disposable decontamination device of this invention in a fully unfolded and erected condition ready for use.
Figure 9:
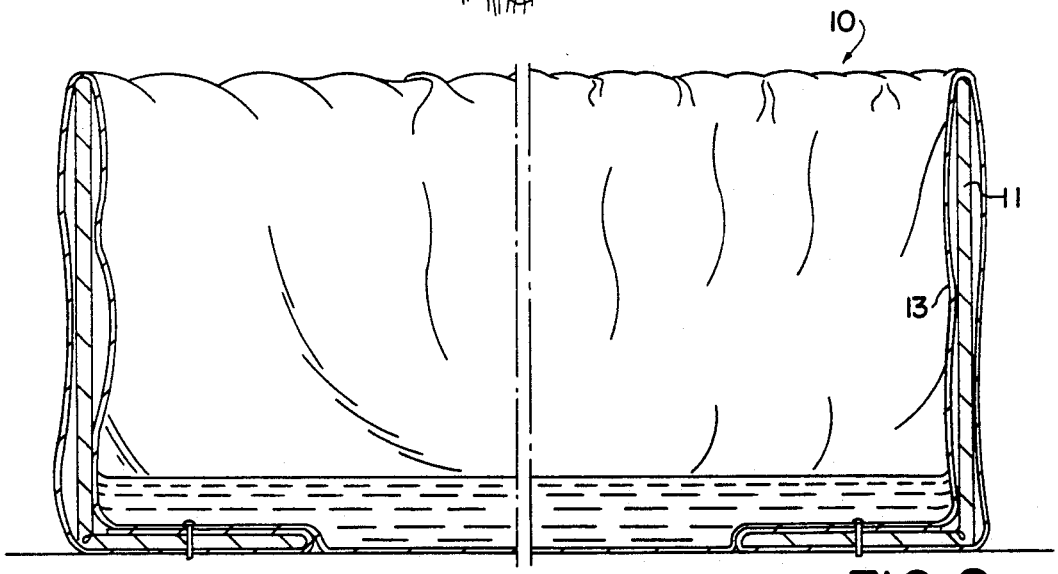
FIG. 9 is a view along line 6—6 of FIG. 5, centrally broken out to eliminate continuous detail.
Figure 10:
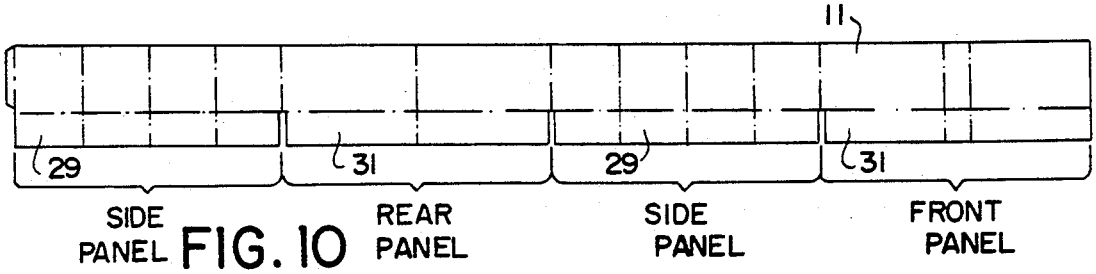
FIG. 10 is a developmental view of the supporting structure showing the panels and their respective crease lines.
Figure 11:
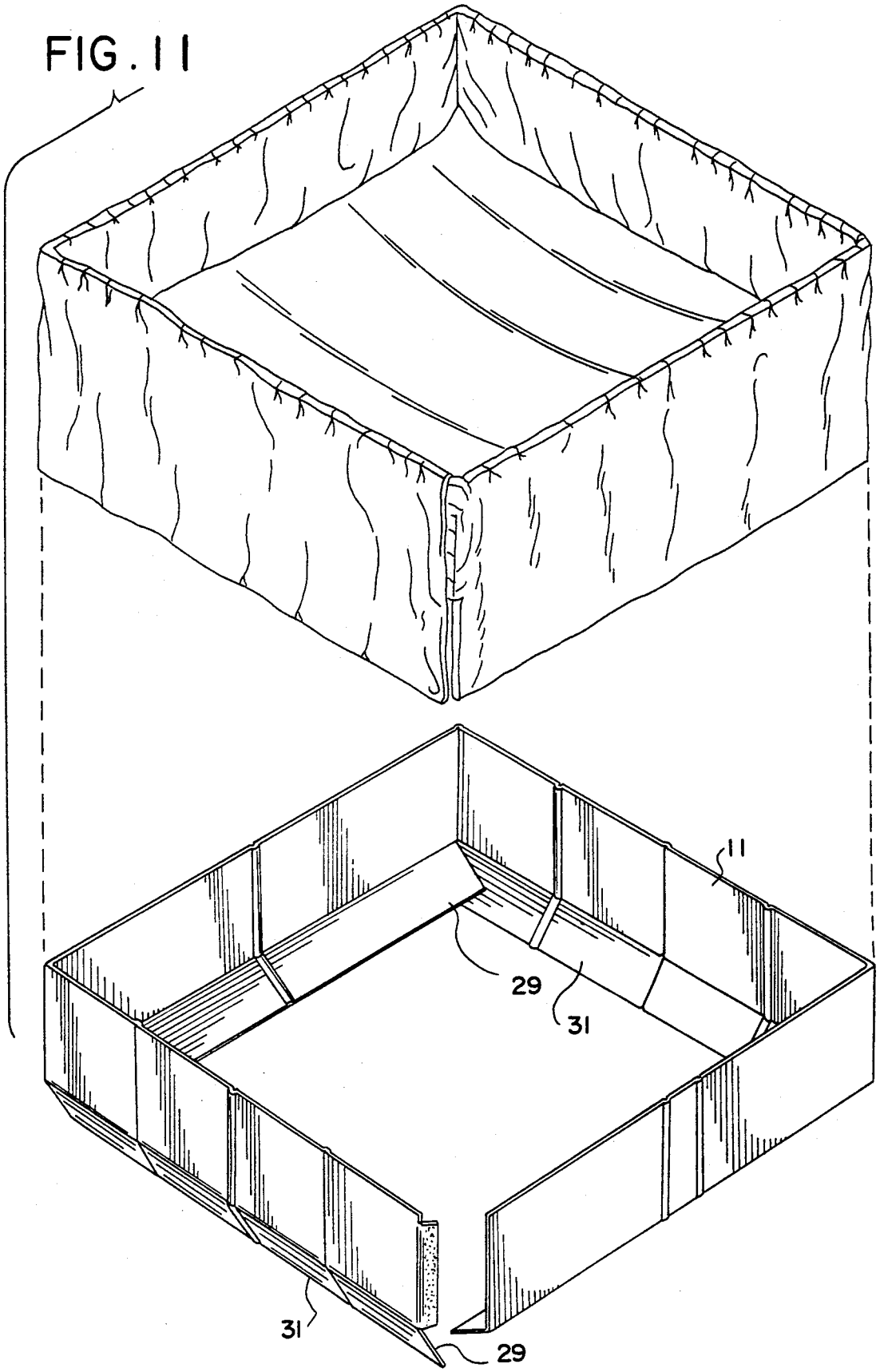
FIG. 11 is a exploded perspective view illustrating the major components of the disposable decontamination device of this invention and other details of construction.

As shown in FIG. 1, the device is compact and collapses to a small, folded size which is easy for storing. The device 10 generally includes an expandable cardboard frame 11, a contaminant resistant liner or basin 13, a tube 15 which is shown in FIG. 2, and a collection vessel 17. The basin 13 is bonded to the outside of frame 11 and thus will drape down from the top of the frame over the stretcher to which it is applied.

The device 10 generally is designed to be used with an ambulance stretcher or a hospital gurney 23 which may or may be on wheels. Typically, the gurney 23 will have a pad 25 or other flat surface which is normally employed to support the patient. The basin 13 drapes on to the pad 25, since it is in this embodiment glued to the outside of frame 11 only.

The patient will usually be lifted onto the gurney 23 by the use of a backboard 27 which has a plurality of handle slots 28 around its periphery.

In an emergency, the folded, pleated device shown in FIG. 1 is quickly unfolded and expanded into a rectangular shape as shown in FIG. 2. It is then placed on the pad 25 of the gurney 23. Drain tubing 15 is already connected to fittings 19, 21, so that the storage vessel 17 can be placed in position to receive the contaminated fluids. In a preferred embodiment, at least one of the fittings 19, 21 is provided with a conventional valve such as a spigot valve so that the fluids draining from the basin 13 to the collection vessel 17 will not escape from the collection vessel 17 until the proper time for permanent disposal.

The patient who is presumably now resting on a backboard 27 is lifted into the basin 13 on the backboard 27. Whatever treatment is necessary to aid in the patient's recovery is then accomplished. For example, radioactive contamination may be washed, as can hazardous materials such as chemical compounds or body fluids.

One particular advantage of the present invention is that the frame 11 and basin 13 can be stabilized in a rectangular shape because the frame includes means for stabilizing the frame. As shown in FIG. 1, tabs 29 extend from the sides of the frame 11 and other tabs 31 extend down from the ends of the frame 11 when the frame 11 is placed upon the pad 25 of the gurney 23, tabs 29 and 31 of the gurney are extended perpendicular to the side and ends for approximately seven inches in from the frame. The tabs 29 and 31 may be locked into place with a fastening means 33. Alternatively, tabs 29 and 31 can be taped to one another to prevent relative movement and insure the stability of the rectangular shape of the frame 11. The contaminating fluid resistant fabric which has been formed into the basin 13 is then checked to insure that it covers at least the side and end walls of the frame and the portion of the gurney which is supporting the frame. As previously mentioned, the tubing 15 and collection vessel 17 are then placed in their appropriate position to receive the contaminated fluids. The fluids are safely kept in the vessel 17 until the entire combination is disposed in a safe place.

FIGS. 4-11 inclusive are provided to further illustrate the present invention.

While particular embodiments of the present invention have been illustrated and described herein, it is not intended to limit the invention and changes and modifications may be made therein within the scope of the following claims.

What is claimed is:

1. A disposable decontamination device comprising a foldable frame expandable to define a rectangular shape sized to accommodate a patient, said frame being a collapsible, pleated, expandable, disposable frame having side and end portions extending vertically and parallel to form an expanded rectangular enclosure large enough to accommodate a patient, said side and end portions consisting of a plurality of panels pleated related to one another along fold lines to guide and permit folding of said frame from an expanded position forming said expanded enclosure to a collapsible folded size, said frame including bottom tabs having fold lines which permit said tabs to extend inwardly from the bottom of said side and end portions and fold inwardly relative to said side and end portions into said rectangle for mutual engagement between said side and end tabs when said frame is expanded to stabilize said frame in said rectangular position and prevent relative movement between said side and said end panels, and a flexible fluid resistant liner forming a collection basis and sized to enclose said frame when positioning a patient therein.

2. A disposable decontamination device as claimed in claim 1 wherein said side and end portions extend vertically to form an expanded rectangle large enough to accommodate a backboard and small enough to fit on a gurney to enclose a portion of the top thereof.

3. A disposable decontamination device as claimed in claim 2 wherein said liner forming said basin is sized to enclose said frame and cover at least the inside of said frame.

4. A disposable decontamination device as claimed in claim 1 wherein said side and end portions extend vertically to form an expanded square large enough to accommodate a backboard.

5. A disposable decontamination device as claimed in claim 1 wherein said liner is a contamination fluid resistant fabric formed into a basin and attached to said frame to enclose the frame.

6. A disposable decontamination device as claimed in claim 1, which further includes locking means for said side and end tabs to prevent relative movement therebetween when said side and end tabs are folded inward into said rectangular shape.

* * * * *